United States Patent [19]

Steere

[11] 4,151,623

[45] May 1, 1979

[54] BATHING DEVICE

[76] Inventor: R. J. Steere, Rte. 3, Box 50-C, Rockwood, Tenn. 37854

[21] Appl. No.: 898,885

[22] Filed: Apr. 21, 1978

[51] Int. Cl.[2] ..... A47K 7/04; A46B 13/06

[52] U.S. Cl. ..... 15/21 R; 4/158; 4/184

[58] Field of Search ..... 15/21 R, 21 C, 21 D, 15/21 E, 97 R; 4/158, 184; 128/56, 62 R

[56] References Cited

U.S. PATENT DOCUMENTS

| | | | |
|---|---|---|---|
| 3,042,949 | 7/1962 | Mosely | 15/21 R |
| 3,085,269 | 4/1963 | Greer | 15/21 R |
| 3,115,322 | 12/1963 | Fleming | 15/21 R X |
| 3,875,604 | 4/1975 | Wurn et al. | 15/21 R |

*Primary Examiner*—Edward L. Roberts

*Attorney, Agent, or Firm*—Cushman, Darby & Cushman

[57] ABSTRACT

A bathing device includes a housing in which is rotatably mounted a shaft with one end of the shaft supporting a scrubbing brush; gearing means are provided within the housing to transmit rotary motion from a water turbine to the brush; the blades of the water turbine are curved and each are provided with a peripheral recess or opening to reduce pressure buildup and turbulence; water is provided to the turbine from a Y-connection from a source under pressure.

10 Claims, 6 Drawing Figures

BATHING DEVICE

BACKGROUND AND BRIEF DESCRIPTION OF THE INVENTION

The present invention relates to bathing devices of the type used to massage and wash the back portion of an individual and which does not require electrical power for its operation.

As is well known, since it is difficult for individuals to reach all the portions of their back, this portion of the human body is often left unscrubbed which can be very detrimental to an individual's health where one works in a congested or dirty environment. In addition, for many people, the massaging of the back during a shower or a bath is very beneficial particularly where the person is suffering from muscle tension, back injuries or the like.

A large number of back scrubbing device have been proposed in the prior art but none, to my knowledge, have been successfully marketed to the public. Among the reasons for this deficiency is the fact that in some of the prior art devices, electrical power was required to provide rotary motion to the scrubbing brush. Such a requirement not only renders the installation of the brush mechanism expensive but also is very inconvenient to maintain in a safety condition. In other types of back scrubbers, manual operation of the brush has been relied upon but this is clearly unsatisfactory where the person utilizing the brush is an invalid or is recovering from an illness or injury.

In still other arrangements, such as those disclosed in U.S. Pat. Nos.

2,068,757 of June 26, 1937;
3,042,949 of July 10, 1962;
3,085,269 of Apr. 16, 1963; and
3,768,462 of Oct. 30, 1973;

water under pressure has been employed to power the brush or scrubbing devices. While such arrangements have been useful in that they have overcome the disadvantages of using either electrical or manual power to effect the scrubbing action, such devices have still been extremely expensive to manufacture and complicated to install on the one hand, or, on the other, appear to be unable to provide adequate scrubbing action to the user as a result of inefficient utilization of the water pressure available.

The present invention provides a back scrubbing device which overcomes the foregoing disadvantages and provides a back scrubbing device that can be inexpensively manufactured but which will reliably operate to provide sufficient scrubbing action to a user without resorting to complicated valving or plumbing connections and which can use ordinary tap pressure as the power source.

In a preferred embodiment, the apparatus of the present invention includes a housing which can be movably mounted on a wall of a bathing enclosure. A separate compartment of the housing encloses a turbine device which consists of a wheel having a plurality of radially extending blades. The blades are concavely shaped on one side and, at their free ends, are each formed with an opening to permit the passage of water past the blades so that, in operation, at least a portion of the fluid stream impinging on the turbine blades will pass through an immediately facing blade to thereby reduce pressure and turbulence and increase the force of the liquid striking the next succeeding blade mounted on the wheel.

The turbine housing also includes a fluid outlet to minimize, if not eliminate, undesirable splashing of the water used to power the turbine. Fluid outlets are provided in the housing to assure that water is provided to the gear mechanism that rotates the brush as well as for providing liquid to the face of the brush to maintain the bristles or scrubbing portion thereof in a moist and softened condition. The meshing surfaces of the gears may be lubricated by the addition of a detergent to the interior of the housing. Of particular importance is the fact that the velocity of rotation of the brush can be easily adjusted by virtue of the fact that the turbine axle is connected to a drive gear which has a much smaller diameter than the gear connected to the axle of the brush which latter gear is substantially of the same diameter as the brush. With this arrangement, a very firm scrubbing action will be achieved without rotating the brush surfaces at an undesirably high speed.

The foregoing and other advantages will become apparent as consideration is given to the following detailed description taken in conjunction with the accompanying drawings, in which:

DETAILED DESCRIPTION OF THE INVENTION

Figure 1:
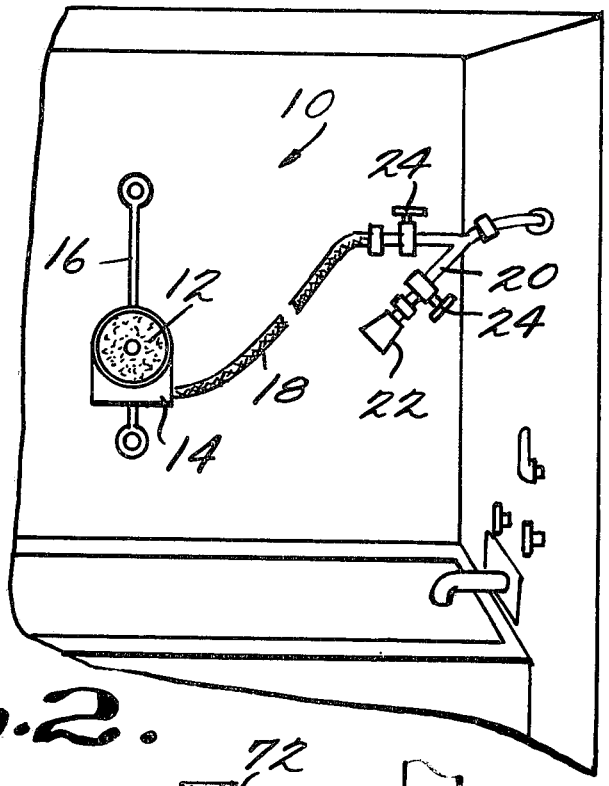
FIG. 1 is an illustration of the installation of the brush massaging apparatus of the present invention.

Referring now to the drawings, wherein like numerals designate corresponding parts throughout the several figures, there is shown in FIG. 1, one installation of the brush massaging apparatus 10 of the present invention. The apparatus 10 generally consists of a brush 12 which is rotatably mounted in a housing 14 which, in turn, is adjustably mounted on a rod 16 which has its ends secured to the wall of a bathing enclosure in any suitable manner. The housing 14 is supplied with water through a flexible tube 18 which has one end connected to the housing and its other end connected to one branch of a Y-connector 20. The other branch of the Y-connector 20 is provided with a conventional shower head 22 and flow through each of the branches may be controlled by manual valves 24.

Figure 2:
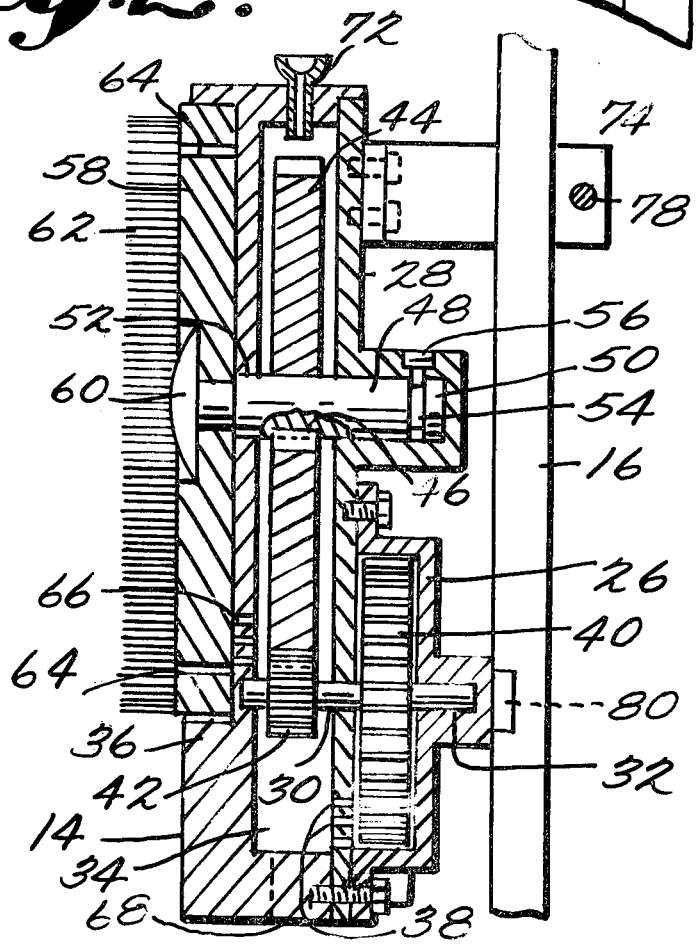
FIG. 2 is a sectional view taken along lines 2—2 of FIG. 3.

Turning now to FIG. 2, a turbine housing 26 is secured by bolts to the rear wall 28 of housing 14 which is provided on its interior with a gear chamber 34. Extending through gear chamber 34 is a turbine axle 30 which has one end mounted in a bore 32 formed in the turbine housing 26 with the other end of the axle 30 mounted in a bore 36 formed on the interior wall of the gear chamber 34. Rear wall 28 has a plurality of apertures 38 disposed as illustrated to provide flow communication between the interior of the turbine housing 26 and the gear chamber 34.

Fixedly mounted on the axle 30 in the turbine housing 26 is a turbine 40. In gear chamber 34, there is a small diameter tooth gear 42 fixedly mounted on turbine axle 30 whereby, when the turbine 40 is rotated, the small tooth gear 42 will also be rotated in the same direction. A large diameter tooth gear 44 is fixedly mounted by a keying connection 46 on a rotatable shaft 48. Shaft 48 has one end disposed in a bore 50 formed in the rear wall 28 of housing 14 and its other end extends through a bore 52 formed through the front face of housing 14. Adjacent the rear end of shaft 48 is a peripheral recess into which is projected an adjustable pin 56 to retain the shaft 48 in a fixed position relative to the inner walls of the gear chamber 34 whereby the teeth of the gears 42 and 44 may be maintained in alignment.

Mounted on a reduced diameter portion of the opposite end of the shaft 48 is a brush plate 58 which is held in position by a threaded screw 60 which can be easily disengaged to permit removal of the brush plate 58 for cleaning or substitution of another type of brush, if desired. On the face of brush plate 58 are a plurality of bristles 62 which, preferably, are the soft type and which may be of synthetic material, such as nylon. About the periphery of the brush plate 58 are a plurality of apertures or bores 64 (FIG. 4) which serve to permit the passage of liquid received from bores 66 which extend through the front face of housing 14. Thus, when liquid from a source enters the gear chamber 34 as a result of the operation of the turbine, any liquid accumulating in the chamber 34 will eventually flow out through bores 66 and 64 to wet the bristles 62 of the brush. At the base of the gear chamber 34, a drain hole 68 is provided which may be closed by a plug 70 (FIG. 3).

At the top of the housing 14 an inlet 72 is provided to permit the addition of a liquid detergent or the like to the gear housing 34. The detergent will act as a lubricant for the gears 42 and 44 as well as for the rotation of the shaft 48 in its mountings in the front wall of the housing 14 and the bore 50 in the rear wall 28.

Bolted or otherwise conventionally secured to the rear wall 28 adjacent the top of the housing 14 is a gripping bracket 74 which has at its outer end a pair of aligned bores 76 for receiving a threaded bolt 78 which will tighten the two arms of the bracket 74 on rod 16 to hold the housing 14 in a desired position on rod 16. To stabilize the housing, a recess 80 is provided on the rear end of the turbine housing 26 to engage and rest upon the rod 16.

Figure 3:
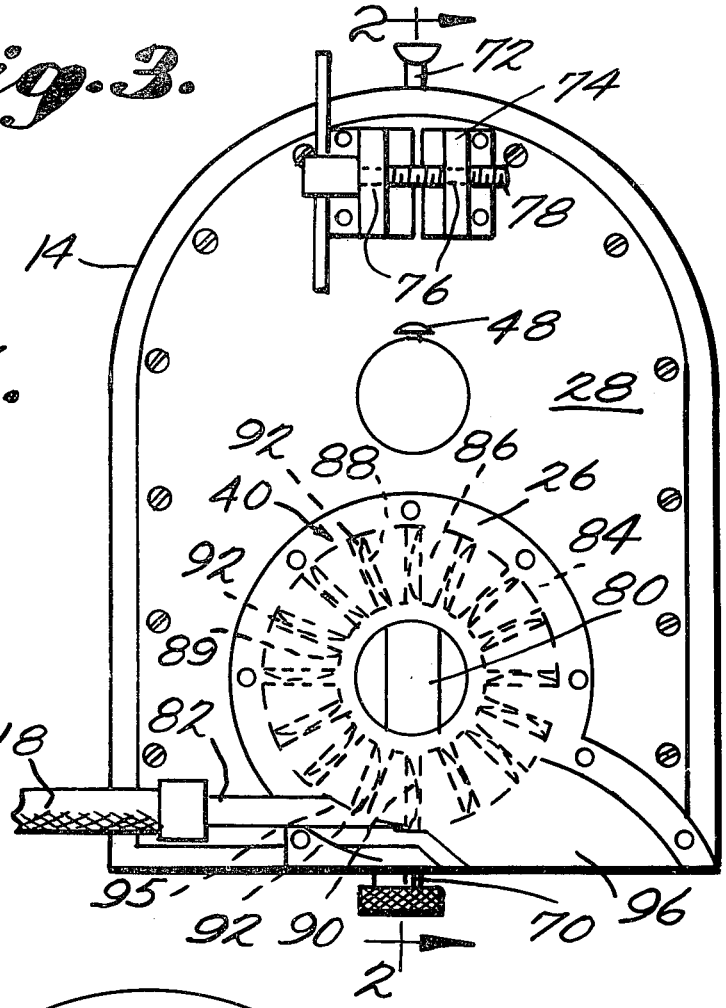
FIG. 3 is a rear view in elevation of the housing for the brush and turbine and brush driving means of the present invention.
Figure 5:
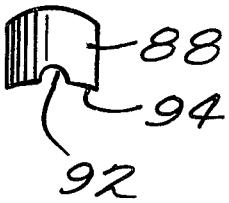
FIG. 5 is a front view in elevation of one of the blades of the turbine.

Turning now to FIG. 3, it will be seen that the flexible tube 18 is connected to a channel 82 which will deliver liquid tangentially to the turbine chamber 86. The turbine chamber 86 has a peripheral wall 84 which is circular and has an interior diameter just slightly larger than the radial extent of the turbine blades 88. The inner ends of each of the blades 88 may be rigidly secured to extend radially from a cylindrical base member 89 which is fixed on turbine axle 30. As can be seen from a consideration of FIGS. 2 and 3, the turbine chamber is cylindrical in shape and is almost fully occupied by the turbine 40 except for clearances required for smooth operation of the turbine.

For smooth operation of the brush, it is important that the turbine 40 have a larger overall diameter than the intermediate tooth gear 42 and yet be smaller than the diameter of the large tooth gear 44. Also, to insure smooth but firm scrubbing action, each of the blades 88 is concavely curved as at 90 to receive the water projected into the turbine chamber 86 from the tangential channel 82. In addition, an opening 92 is centrally located between the side edges of each of the blades 88 along the outer peripheral edge 94 thereof. Closely adjacent the water inlet 95 is the water exhaust outlet 96 in the turbine housing 26. With this arrangement, the accumulation of pressure and turbulence between the blades is minimized thereby assuring smooth transfer of the water's momentum to the turbine 40. Further, it should be noted that the exhaust outlet 96 is downwardly directed to minimize splattering of the water out of the tub.

The provision of the openings 92 at the peripheral end of each of the blades 88 also functions to increase the time interval each of the blades 88 is exposed to the force of the water since the water passing through each of the openings 92 will impact against a preceding blade at least until the blade passes over the exhaust outlet 96.

Figure 4:
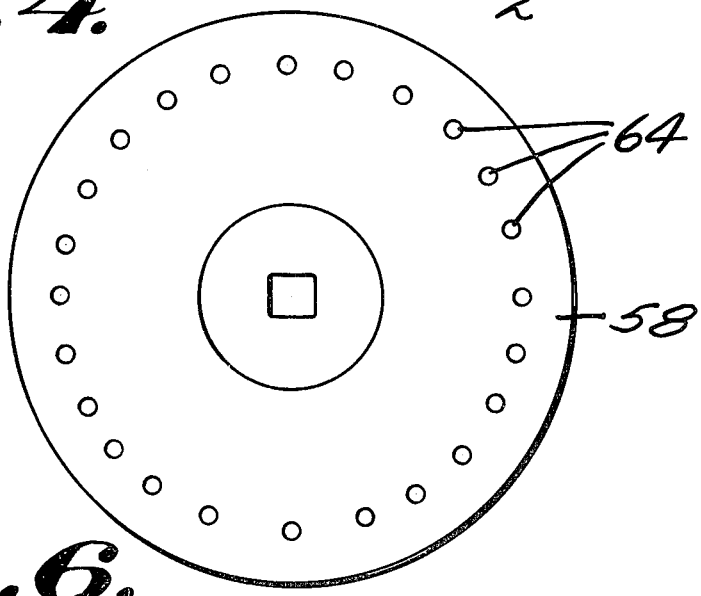
FIG. 4 is a front view in elevation of the base plate for the brush.

In FIG. 4, the distribution of the water hole 64 in the brush plate 58 is illustrated. It will be apparent, however, that other distributions of the holes 64 may be utilized.

Figure 6:
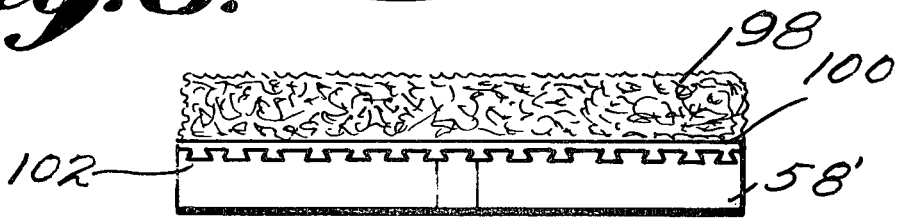
FIG. 6 is a side view of an alternate embodiment of the brush of the present invention.

In FIG. 6, an alternate scrubbing device is shown and which includes a circular sponge 98. The back surface of the sponge 98 is covered with a thick adhesive layer 100 which is pressed into the dovetail slots 102 formed in the face of the brush plate 58'. When the adhesive hardens, it forms a secure bond over the entire surface of the sponge 98 with the face of the brush plate 58' as the adhesive is pressed into the dovetail slots 102 to fill the slots to form a secure anchor. A number of adhesive substances are commercially available for this purpose.

Preferably, the elements of the housing, gears, turbine and mounting bracket should all be made of a high impact plastic material and the entire device can be manufactured without any metal parts, if desired, and yet will provide a firm and smooth massaging and scrubbing action without resort to the use of electrical power or manual manipulation.

Having described the invention, it will be apparent to those skilled in this art that various modifications may be made therein without departing from the spirit and scope of this invention as defined in the appended claims.

What is claimed is:

1. A brush massaging apparatus comprising a housing, a liquid flow operated turbine means mounted in said housing, a brush, an axle rotatably mounted in said housing and supporting said brush externally of said housing for rotation therewith, gear means for transmitting rotary motion from said turbine to said brush, and means for conveying fluid to drive said turbine means, said turbine means including a wheel, a plurality of blades extending substantially radially from said wheel, means mounting said wheel for rotation in said housing, each said blade having a free end with a recess formed therein to permit a portion of the liquid impinging on a said blade to pass through said recess.

2. The apparatus as claimed in claim 1 wherein each said blade has a given width and said recess is located substantially at the midpoint of said given width.

3. The apparatus as claimed in claims 1 or 2 wherein said turbine means is surrounded by a peripheral wall and side walls defining a cylindrical chamber the diameter of which is substantially equal to the combination of the lengths of two of said blades, said peripheral wall having a tangentially disposed fluid inlet and a fluid outlet including a flow deflection surface.

4. The apparatus as claimed in claim 3 wherein at least one of said walls of said chamber is provided with passage means to permit liquid to flow from said chamber into said housing, said housing having passage means to permit liquid to flow from said housing to said brush, said brush having a disc member for supporting bristles, said disc member having a plurality of apertures for passing liquid to said bristles.

5. The apparatus as claimed in claim 1 wherein said housing includes a passage for supplying a detergent to the interior of said housing.

6. The apparatus as claimed in claim 1 wherein means for mounting said housing are provided including a tube having ends provided with surface engaging members, said housing having a rear wall and an adjustable tube clamping element mounted on and extending from said rear wall, a tube engaging element extending from said housing and spaced vertically below said tube clamping element.

7. The apparatus as claimed in claim 1, wherein said gear means includes a first toothed gear wheel rotatably mounted in said housing and having a selected diameter, said first toothed gear wheel being directly coupled to said turbine means to be rotatable therewith, a second toothed gear wheel rotatably mounted on said axle in said housing and in engagement with said first gear wheel so as to be rotated thereby, the diameter of said second gear wheel being greater than said diameter of said first gear wheel.

8. The apparatus as claimed in claim 1, wherein said means for conveying liquid includes a flexible conduit having one end thereof connected to said housing and, at its other end, a threaded member for connection to a conduit.

9. The apparatus as claimed in claim 8, wherein said threaded member includes a Y-shaped connector with two branches, each branch having valve means for controlling flow therethrough.

10. The apparatus as claimed in claim 1 wherein each said blade is concavely curved in a direction facing said means for conveying fluid.

* * * * *